US006254111B1

(12) United States Patent
Servant

(10) Patent No.: US 6,254,111 B1
(45) Date of Patent: Jul. 3, 2001

(54) SNOWBOARD WITH BRAKING MANEUVERING AND BINDINGS FEATURES

(76) Inventor: Jean-Hugues Servant, 1999 Chemin Adamsville, Bromont, Quebec (CA), J2L 2Z7

( * ) Notice: Subject to any disclaimer, the term of this patent is extended or adjusted under 35 U.S.C. 154(b) by 0 days.

(21) Appl. No.: 09/517,881

(22) Filed: Mar. 2, 2000

(30) Foreign Application Priority Data

Mar. 2, 1999 (CA) ..... 2264363

(51) Int. Cl.[7] ..... B62B 9/04
(52) U.S. Cl. ..... 280/14.22
(58) Field of Search ..... 280/601, 604, 280/608, 609, 14.2, 18.1, 14.21, 14.22, 14.26, 28.11

(56) References Cited

U.S. PATENT DOCUMENTS

| | | | | |
|---|---|---|---|---|
| 2,762,063 | * | 9/1956 | Quinn | 280/14.2 |
| 3,332,697 | * | 7/1967 | Hagen | 280/14.2 |
| 3,628,804 | * | 12/1971 | Carreiro | 280/18 |
| 3,947,049 | * | 3/1976 | Pedersen | 280/11.13 |
| 5,106,109 | * | 4/1992 | Tattersall et al. | 280/9 |
| 5,149,117 | * | 9/1992 | Wilkens, Sr. et al. | 280/18.1 |
| 5,462,304 | * | 10/1995 | Nyman | 280/609 |
| 5,791,678 | * | 8/1998 | Perlman | 280/618 |
| 5,868,405 | * | 2/1999 | Lavecchia et al. | 280/14.2 |

FOREIGN PATENT DOCUMENTS

| | | | | |
|---|---|---|---|---|
| 2322211 | * | 11/1973 | (DE) | 280/18.1 |
| 3903401 | * | 8/1990 | (DE) | 280/14.2 |
| 362782 A2 | * | 4/1990 | (EP) | 280/14.2 |
| 2383679 | * | 10/1978 | (FR) | 280/14.22 |
| 2437850 | * | 4/1980 | (FR) | 280/14.22 |

* cited by examiner

*Primary Examiner*—Brian L. Johnson
*Assistant Examiner*—G B Klebe

(57) ABSTRACT

A snowboard with braking, maneuvering and binding features that allows sliding on snowy slopes. The snowboard may be one meter long and 0.66 meter wide for a medium size person and may be smaller for a child or larger for an adult. The inner face is rounded to allow the rotation of the user and the dome about a vertical axis. Two bindings are included and accommodate to different types of boots, from a typical winter boot to a ski boot. Humps on the rear of the underside are used to brake and humps near the sides to steer.

4 Claims, 2 Drawing Sheets

SNOWBOARD WITH BRAKING MANEUVERING AND BINDINGS FEATURES

BACKGROUND-FIELD OF INVENTION

This invention belongs to the family of sporting goods to slide on snow particularly to a snowboard with braking, maneuvering and binding features.

BACKGROUND-DESCRIPTION OF THE PRIOR ART

The search for means for sliding on snow has disclosed the existence of elongated forms as skis and snowboards. Cross-country skis usually have a width of 5 cm for a length of 200 cm, that is a 40:1 ratio. But a cross-country ski does not necessitate a lot of veering and does not require special guides to do so. Downhill skis generally have a ratio of 25:1. These skis veer by leaping and use their sides to control the direction. As for snowboards, they have a ratio of 25 cm on 150 cm that is a 6:1 ratio. The width of a snowboard makes it easier for users to steer by shifting their weight to the sides, without leaps. There also are one meter convex disks for kids that do not comprise fasteners nor means to change directions.

OBJECTS AND ADVANTAGES

The first objective of this invention is to provide an article that has a certain length so it can be steered and has the ability to brake while having the stability of a dome.

Another objective is to provide sporting gear with a length to width ratio of 2:1. Its rear part has humps to facilitate the steering. The dome has fasteners for the feet to allow the user to stay up and secure when sliding downhill while allowing acrobatics.

BRIEF DESCRIPTION OF THE DRAWINGS

The present invention will be further understood from the following description with reference to the drawings in which.

DESCRIPTION OF THE PREFERRED EMBODIMENT

Figure 1:
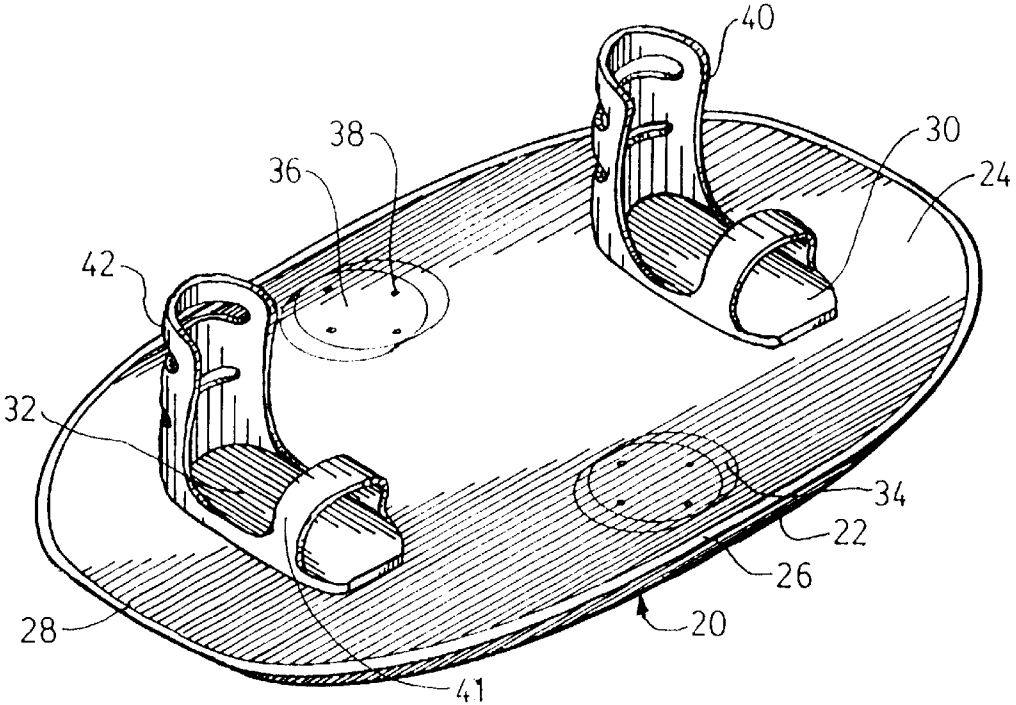
FIG. 1 is a perspective of the top of a snowboard.

The preferred embodiment of the invention is illustrated in FIG. 1 where the same characterising elements are identified by the same numbers.

FIG. 1 shows an elongated dome 20 also known as a cupola having a rectangular shape with rounded corners 45 (FIG. 2), a concave upper face 24 and a convex underside 22. There are four fastening locations: two lengthways 30 and 32 and two widthways 34 and 36, all with fixing screws 38. The left and right fasteners 30 and 32 are located on each end of the dome to receive left and right bindings 40 and 42, parallel to the width 28 of the dome 20 and with a foot support 41. The toe and the heel of a binding may be turned depending on a left or right handed person, at convenience.

Figure 2:
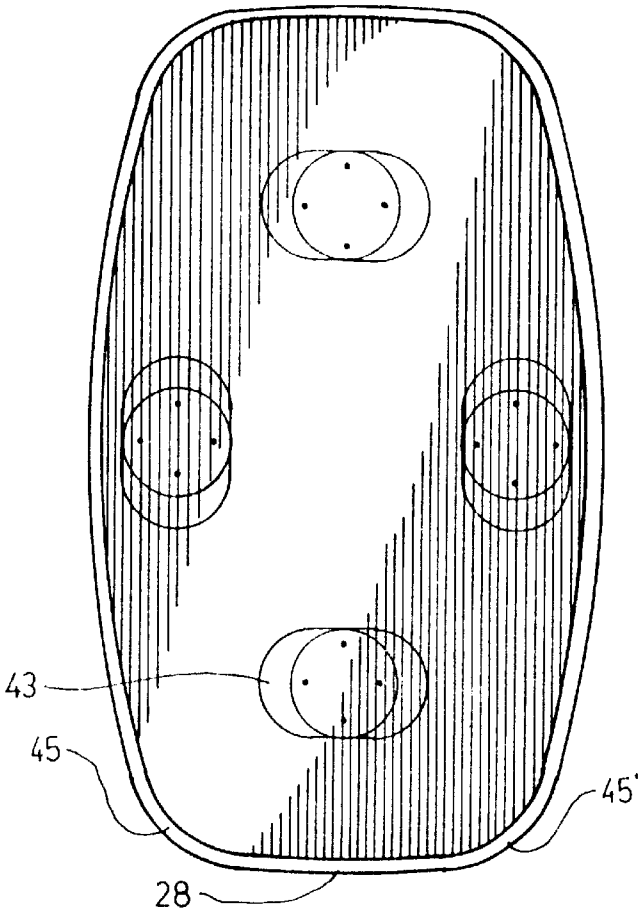
FIG. 2 is a top view of snowboard of FIG. 1

FIG. 2 illustrates the upper face 24 of the dome, showing an underside 43 of the bindings. Lengthways, the fasteners, right 30 and left 40, are set by the sides 28 and centred. The same applies for the fasteners widthways, right 34 and left 36. They are set near the longer sides 26 and centred. Four fixing screws 38 are located on each fastener 30, 32, 34 and 36 to fix in place the bindings 40 and 42 (FIG. 1).

Figure 3:
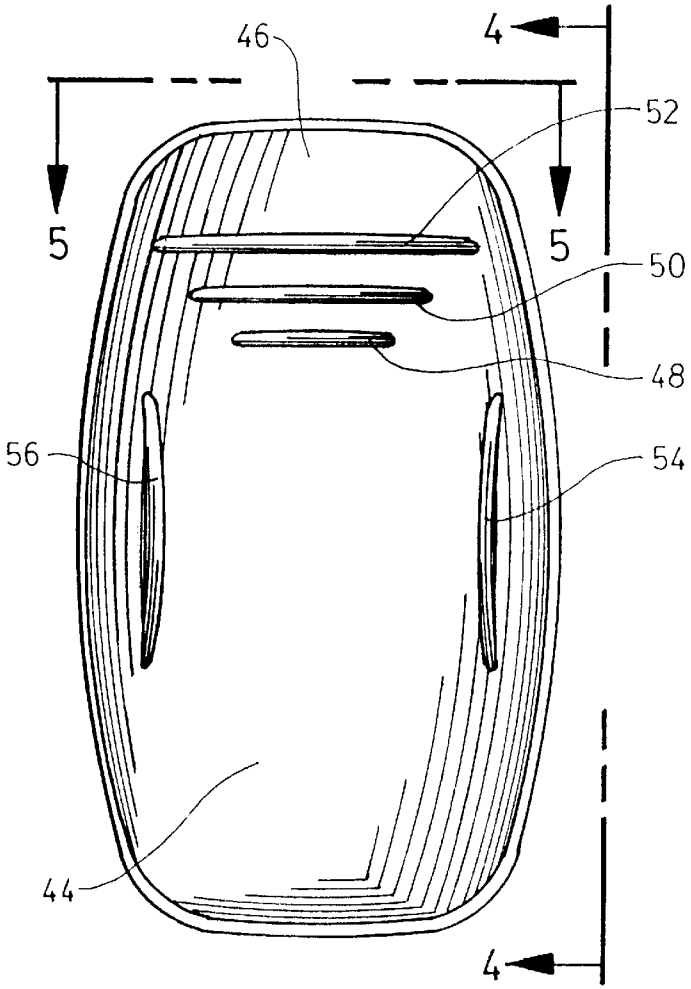
FIG. 3 is a bottom view of the snowboard of FIG. 1

FIG. 3 shows the underside 22 of the dome 20. The front 44 surface is smooth while the rear 46 has braking humps 48, 50, 52 across the width and parallel to each other. The inner hump is the soft braking hump 48 and is the shortest one. The middle one is the moderate braking hump 50, a bit longer and the full braking hump 52 is the outer one and the longest. The user just has to vary the pressure on the rear 46 of the dome 20 to control its speed. The underside 22 also comprises two other humps, left 54 and right 56, parallel and centred on the length of the dome 20 to facilitate the steering.

Figure 4:
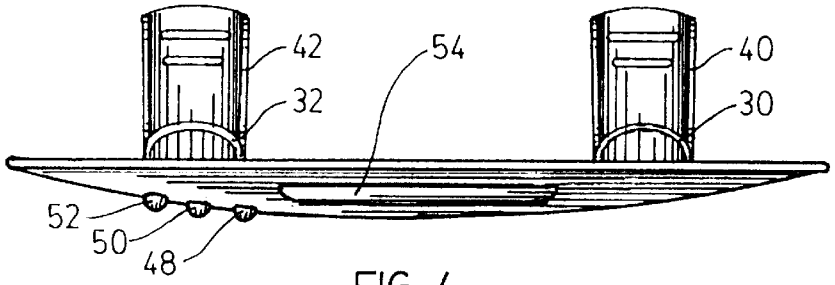
FIG. 4 is a side view of the snowboard of FIG. 1

FIG. 4 shows the dome with the bindings 40 and 42 placed on the fasteners 30 and 32. The humps 48, 50 and 52 are right under the right binding 42.

Figure 5:
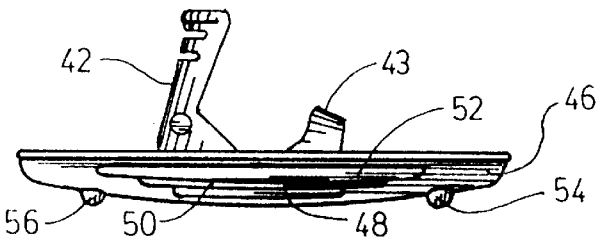
FIG. 5 is view of the end of the snowboard of FIG. 1

FIG. 5 shows the dome 20 from the rear. It clearly shows the location of the braking humps 48, 50 and 52 as well as the right and left humps 54 and 56, in relation to the bindings.

DIRECTIONS FOR USE

The user puts his boots on and fixes them to the dome either on the length side or the width side. The user starts sliding by shifting his weight onto the smooth end. Braking is done by shifting one's weight onto the embossed end, which happens to be in a backward direction with respect to the displacement motion. First by a vertical pressure is against the soft braking hump 48, then gradually up to a slope of 9° to 15° against the longer braking humps to a full stop. To veer, the user shifts his weight on the corresponding side humps, the right hump 54 to turn right and the left hump 56 to turn left, causing a track on the snow and thus a smooth curve on the appropriate side. Any convex form on which is applied the hump will cause a change of direction.

SUMMARY

My dome has a convex underside, a concave upper face, sides, a front and a rear. It comprises a number of fastener locations on the upper face to fasten the bindings. It also comprises braking humps on the rear part of the underside to control the speed and the braking and steering humps, along the right and left sides of the underside to allow a change of direction.

They are generally four fasteners, two lengthways and two widthways. The bindings are preferably fixed on the front to rear positions for the user to behave as if on a snowboard and they may be also fixed on the sides for the user to behave as on a ski.

The braking humps have gradual lengths; the inner one is the shortest to slow down the dome and the outer hump is the longest, almost as long as the width of the dome to bring it to a full stop.

The dome is not round but rather elongated 1.3 to 3 and preferably 1.5 to two times the width. For a child typical dimensions may be 40 cm by 80 cm, for an adult 60 cm by 100 cm. Other sizes are possible depending on the weight of a user and depending on the applications, such as a sled or replacement for a bobsleigh.

Other embodiments are possible and limited only by the scope of the appended claims:

I claim:

1. A snowboard (20) with braking, maneuvering and binding features comprising a generally rectangular platform shape with front (44) and rear (46) short width sides, and long right and left sides extending between said front and rear sides, said snowboard having a generally convex underside, both lengthways and widthways, and a concave upper face, said snowboard comprising:

a plurality of binding mounting means for mounting a pair of bindings in an alternatively longitudinally or laterally spaced location on a concave upper face;

a broad rectangular central area covering most of said underside, being convex and smooth, having right and left side limits at a certain distance of said, right and left, long sides, a front limit coinciding with said front side and a rear limit being at a certain distance of said rear side, braking humps being disposed between said rear limit and said rear side of said underside for allowing control of the sped and steering humps being disposed between said side limits and said right and left long sides, to allow a change in direction.

2. The showboard of claim 1 wherein said braking humps are of a graduated length; that is a short inner one to slow down said dome followed by a moderate middle one and an outer long hump covering most of the width of said dome.

3. The snowboard of claim 1 wherein said steering humps are generally parallel to said long sides, said steering humps being curved, with their extremities pointing towards an adjacent long side.

4. The snowboard of claim 1 wherein the length of said long sides is 1.3 to 3 times the width.

* * * * *